US006431491B1

(12) United States Patent
Biagiotti

(10) Patent No.: US 6,431,491 B1
(45) Date of Patent: Aug. 13, 2002

(54) PERFORATOR FOR WEBLIKE MATERIALS WITH MEANS FOR MODIFYING THE INTERVAL BETWEEN CONSECUTIVE LINES OF PERFORATIONS

(75) Inventor: Guglielmo Biagiotti, Via di Vorno (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 09/744,397

(22) PCT Filed: Jul. 21, 1999

(86) PCT No.: PCT/IT99/00230

§ 371 (c)(1),
(2), (4) Date: Jan. 24, 2001

(87) PCT Pub. No.: WO00/06351

PCT Pub. Date: Feb. 10, 2000

(30) Foreign Application Priority Data

Jul. 27, 1998 (IT) ..... FI98U0081

(51) Int. Cl.[7] ..... B65H 18/08; B26D 1/62
(52) U.S. Cl. ..... 242/526.1; 83/349; 83/695
(58) Field of Search ..... 242/526.1; 83/678, 83/695, 349

(56) References Cited

U.S. PATENT DOCUMENTS

| | | | | |
|---|---|---|---|---|
| 3,552,251 A | | 1/1971 | Neff | |
| 3,871,257 A | | 3/1975 | Schmermund | |
| 3,898,900 A | * | 8/1975 | Schmermund | 83/349 |
| 5,284,304 A | | 2/1994 | Biagiotti | |

FOREIGN PATENT DOCUMENTS

| | | |
|---|---|---|
| DE | 36 13859 A | 10/1987 |
| EP | 0 783 940 A3 | 7/1997 |
| EP | 0 783 940 A2 | 7/1997 |
| WO | WO 90/02639 | 3/1990 |

* cited by examiner

*Primary Examiner*—John M. Jillions
(74) *Attorney, Agent, or Firm*—Breiner & Breiner, L.L.C.

(57) ABSTRACT

The perforating unit comprises: a support (23) with at leat two fixed counterblades (25A, 25B); a first roller (27) revolving about its own axis and carrying a first series of rotary blades (29) acting in combination with a first (25A) one of said fixed counterblades; a second roller (31) revolving about its own axis nd carrying a second series of rotary blades (33) acting in combination with the second (25B) one of said fixed counterblades. The blades of the first series are arranged at a different pitch from the blades of the second series of blades.

12 Claims, 1 Drawing Sheet

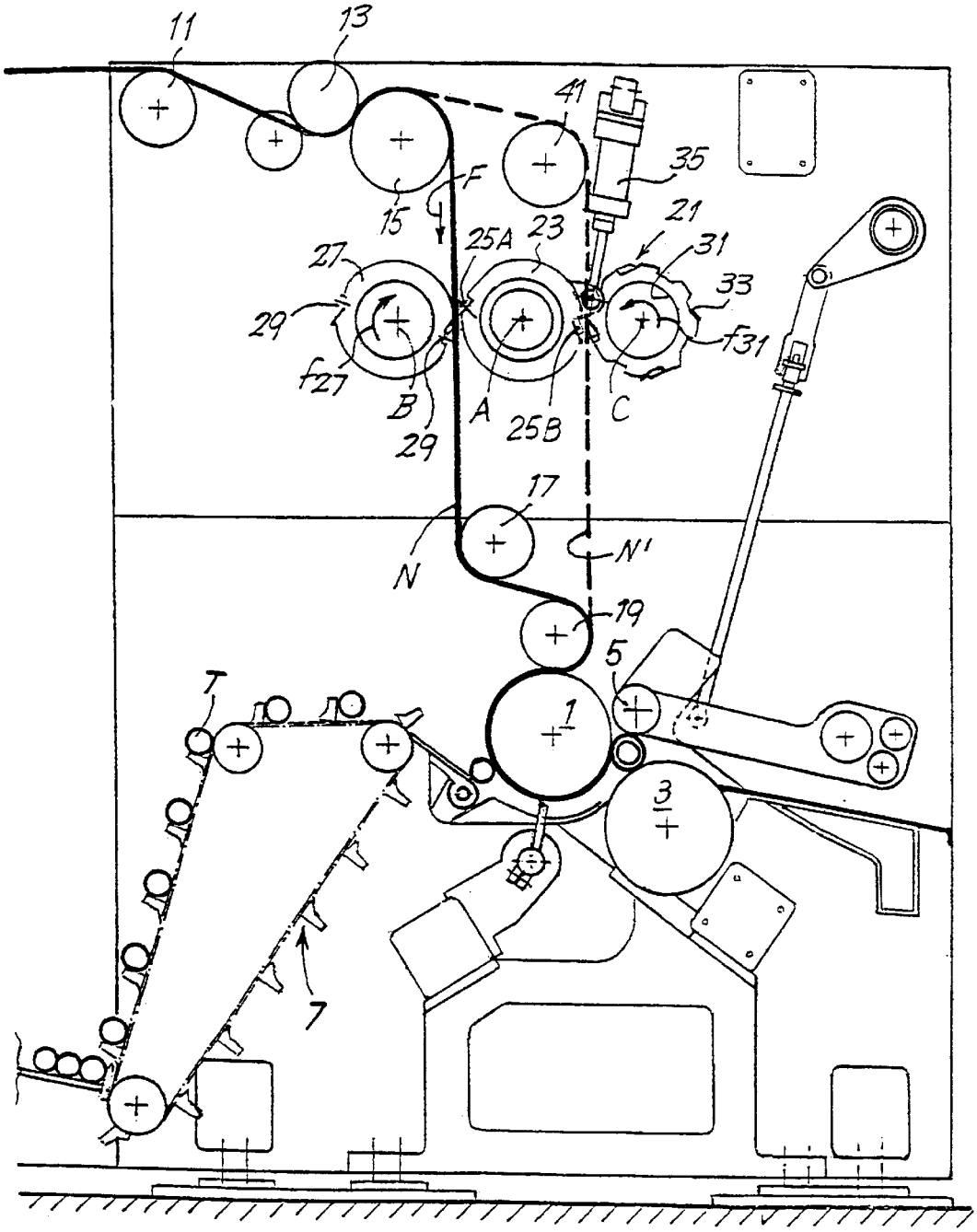
11
13
41
35
F
15
21
25A
23
31
27
33
29
f31
f27
B
A
C
29
25B
17
N
N'
19
5
T
1
3
7

PERFORATOR FOR WEBLIKE MATERIALS WITH MEANS FOR MODIFYING THE INTERVAL BETWEEN CONSECUTIVE LINES OF PERFORATIONS

The present invention relates to a perforating unit of the type commonly used for making transverse lines of perforations at predetermined intervals on a weblike material, for example a web or sheet of tissue paper for the production of toilet paper, kitchen towels or the like.

A device of this kind is described in U.S. Pat. No. 5,284,304. The lines of perforations are arranged at intervals from each other defined by the type of use to which the material perforated in this way is put. For example, when this material is used for the production of rolls of toilet paper, the distance between consecutive lines of perforations is relatively small and corresponds to the length of the single sheets of toilet paper that can be torn off along the lines of perforations when the weblike material has been converted into rolls of toilet paper. In the production of rolls of kitchen towels, the interval between the lines of perforations is greater, approximately twice the interval between the lines of perforations of toilet paper. Typically, the interval between the lines of perforations is 100–140 mm for toilet paper and 220–280 for kitchen towels. Even larger distances, e.g. 380–400 mm are used for products for industrial use. Lengths of 1800–2000 mm are used for the production of rolls for medical use, e.g. for covering examination beds and folding beds.

At the present time, the perforating units used for these purposes comprise a support equipped with a basically fixed counterblade acting in combination with a certain number of rotary blades carried by a roller revolving about its own axis. The interval between the lines of perforations can be modified within certain limits (approximately 20%) by varying the speed of rotation of the bladed roller and thereby introducing slippage between the rotary blades and the weblike material passing between them and the fixed counterblade. To maintain perpendicularity between the feed direction of the weblike material and the line of perforations when this speed variation is introduced, it becomes necessary to vary the inclination of the support of the fixed counterblade and of the revolving roller relative to the feed direction of the weblike material.

The variations to the intervals between adjacent lines of perforations that can be produced in this way are not enough to convert from the interval required for toilet paper to that required for kitchen towels. In these cases it is also necessary to modify the number of blades mounted on the revolving roller. For example, if six blades are used in making toilet paper, to switch to the making of kitchen towels three of the six blades mounted on the rotary roller must be removed. Subsequent return to making toilet paper necessarily requires replacement of all blades, as the three blades that have temporarily been producing the kitchen towels will have become more worn than the three blades that were removed when switching from the production of toilet paper to kitchen towels.

The removal of some of the blades and/or the replacement of all of the blades when switching from one type of product to the other takes up a great deal of time and therefore requires long machine down times with consequent loss of output, besides high costs caused by the impossibility of using entirely all the blades.

The object of the present invention is to provide a perforating device that overcomes this problem and makes it possible to switch quickly from one type of production to another characterized by different intervals between adjacent lines of perforations, thereby reducing unused time to a minimum. Another object of the present innovation is to provide a device that does not require the blades to be replaced until actually completely worn down.

These and other objects and advantages, which will be clear to those skilled in the art on reading the text that follows, are achieved basically with a perforating unit comprising:

- a support with at least two fixed counterblades;
- a first roller revolving about its own axis and carrying a first series of rotary blades acting in combination with a first one of said fixed counterblades;
- a second roller revolving about its axis and carrying a second series of rotary blades acting in combination with the second one of said fixed counterblades, the blades of said first series being arranged at a different pitch from the blades of the second series of blades.

With this device, in order to switch from one production to the other, the path of the weblike material need simply be modified. In one case it will pass between the first revolving roller and the fixed support, and in the other case it will pass between the second revolving roller and the same fixed support. Depending on the path of the weblike material, one or other of the two counterblades carried by the intermediate support will act in combination with one or other of the two series of blades carried by the two revolving rollers.

The different circumferential pitch between the two series of blades can be obtained with two rotary rollers equipped with different numbers of blades, for example twice as many blades on one roller as on the other. Alternatively, the two series of blades could have the same number of blades but they could be arranged on revolving rollers of different diameters. Also possible are combinations of these two solutions, i.e. the use of revolving rollers of different diameters and carrying different numbers of blades.

In one possible embodiment, one of the two revolving rollers comprises twice as many blades as the other, for example four blades on one roller and two on the other, or three blades on one roller and six on the other.

Advantageously, the support carrying the two fixed counterblades may be connected to members that modify its angular position in order to bring one or other of the fixed counterblades alternately into operation, e.g. by a slight pivoting about an axis.

As in the prior art, so in the device according to the invention the two revolving rollers and the support may have a variable inclination that can be adjusted to obtain a further possibility of variation (within narrow limits) of the interval between consecutive lines of perforations produced on the weblike material.

Other advantageous characteristics of the device according to the invention will be explained below and are indicated in the appended claims.

The single figure attached shows a schematic side view of a rewinding machine comprising a perforating unit according to the invention.

In the attached figure the rewinding machine has a set of three winding rollers marked 1, 3 and 5, upstream of which is a feed system 7 for tubular cores T on which a weblike material is wound. The structure of the rewinding machine is known per se and will not be described in greater detail below. The perforating unit which will be described later may typically be connected to this type of rewinding machine, but there is no reason why it should not also be adopted in other types of machine where similar problems and requirements arise.

The weblike material N is fed toward the winding zone defined by the set of three rollers 1, 3 and 5 along a path defined by cylinders 11, 13, 15, 17 and 19. Between the cylinders 15 and 17 is a perforating unit 21 comprising a central support 23 with axis A carrying a pair of counterblades 25A, 25B in symmetrically opposite positions on the support 23.

To the left (when viewing the figure) of the support 23 is a first revolving roller 27 rotating in the direction of the arrow f27 about an axis B. A first series of two rotary blades 29 is fixed in diametrically opposite positions to the revolving roller 27. The blades 29 act in combination with the counterblade 25A of the fixed support 23.

To the right of the support 23 (when viewing the figure) is a second revolving roller 31 rotating about an axis C in the direction of the arrow f31 and carrying a second series of four rotary blades 33 distributed uniformly around the circumference of the roller 31. The rotary blades 33 act in combination with the fixed counterblade 25B mounted on the support 23. The roller 31 also possesses another series of four seats for optional application of four more rotary blades.

The support 23 can pivot about its axis A, being controlled in this by a cylinder-and-piston actuator 35. By pivoting the support 23 appropriately, it is possible to bring into operation either the fixed counterblade 25A or the fixed counterblade 25B.

As known per se, the blades 29 and 33, or the counterblades 25A and 25B, are toothed so as to produce lines of perforations on the weblike material N. Again as known per se, the rotary blades 29 and 33 may run helically about their respective revolving rollers 27 and 31 and these latter, like the support 23, are in this case inclined relative to the normal to the forward direction F of the weblike material N. Perforation therefore takes place progressively point by point and the result is lines or perforations that are exactly perpendicular to the sides of the weblike material N and therefore to the forward direction of said material. It is also possible, as known to those skilled in the art, to modify the angular velocity of the roller 27 or of the roller 31 and to modify appropriately the inclination of the support 23 and of the working roller in order to vary within certain limits the interval between the lines of perforations by introducing a relative speed between the weblike material N advancing in the direction of the arrow F and the rotary blades 29 or 33. When altering this inclination, care is taken to keep the axes of the rollers 27, 31 and support 23 parallel with each other.

In the figure, a solid line shows the weblike material N passing between the rotary blades 29 and the fixed counterblade 25A. The large angular distance between the blades 29 enables lines of perforations to be produced on the weblike material at relatively long distances, e.g. for the production of kitchen towels.

The figure also shows, in a broken line, an alternative path for a weblike material N' which is guided about an auxiliary cylinder 41 so that its path runs between the counterblade 25B and revolving roller 31. In this condition the relative angular proximity of the rotary blades 33 enables a weblike material to be produced with closer lines of perforations, e.g. for the production of toilet paper.

As mentioned earlier, the different distance between the blades of the first series of blades 29 compared to the distance between the blades of the second series of blades 33 can be achieved by using revolving rollers 27, 31 of different diameters.

What is claimed is:

1. A perforating unit for a weblike material comprising:

a support with at least two fixed counterblades;

a first roller revolving about its own axis and carrying a first series of rotary blades acting in combination with a first one of said fixed counterblades; and a second roller revolving about its own axis and carrying a second series of rotary blades acting in combination with the second one of said fixed counterblades;

wherein the blades of said first series being arranged at a different pitch from the blades of the second series of blades, alternatively said first or said second roller cooperating with the respective counterblade; and wherein the perforating unit includes two alternative paths for said weblike material, a first one of said paths passing between said first roller and said first counterblade and a second one of said paths passing between said second roller and the second counterblade.

2. Perforating unit according to claim 1, wherein said first and said second roller revolve in opposing directions.

3. Perforating unit according to claim 1 wherein said two alternative paths are arranged tangent to the relevant roller and to the support carrying the counterblades.

4. Perforating unit according to claim 1 in which said support can adopt at least two different angular positions in order to bring one or other of said fixed counterblades alternately into operation.

5. Perforating unit according to claim 2, wherein said support can adopt at least two different angular positions in order to bring one or other of said fixed counterblades alternatively into operation.

6. Perforating unit according to claim 3 wherein said support can adopt at least two different angular positions in order to bring one or other of said fixed counterblades alternatively into operation.

7. Perforating unit according to claim 1, 2, 3, 4, 5, or 6 wherein said first series of blades comprises a different number of blades than the number of blades of the second series of blades.

8. Perforating unit according to claim 1, 2, 3, 4, 5 or 6 wherein said first revolving roller and said second revolving roller have different diameters.

9. Perforating unit according to claim 1, 2, 3, 4, 5 or 6 wherein said first series of rotary blades comprises twice as many blades as the second series.

10. Perforating unit according to claim 1, 2, 3, 4, 5 or 6 wherein said fixed counterblades and said rotary blades are inclined relative to the transverse direction of the weblike material to be perforated and said rotary blades are helical in form.

11. Perforating unit as claimed in claim 10, in which said fixed counterblades and said rotary blades have a variable inclination with respect to the transverse direction, of the weblike material to be perforated.

12. A rewinding machine including a perforating unit according to claim 1, 2, 3, 4, 5 or 6.

* * * * *